US005310077A

United States Patent [19]

McDermott et al.

[11] Patent Number: 5,310,077

[45] Date of Patent: * May 10, 1994

[54] BASKET LINER

[76] Inventors: Susan M. McDermott, 12216 Izard St.; Mary J. Ellis, 1405 N. 125th Cir., both of Omaha, Nebr. 68154

[ * ] Notice: The portion of the term of this patent subsequent to Mar. 24, 2009 has been disclaimed.

[21] Appl. No.: 41,694

[22] Filed: Apr. 1, 1993

Related U.S. Application Data

[60] Continuation-in-part of Ser. No. 890,443, May 27, 1992, Pat. No. 5,240,134, which is a division of Ser. No. 842,217, Feb. 26, 1992, Pat. No. 5,181,627, which is a continuation-in-part of Ser. No. 690,109, Apr. 23, 1991, Pat. No. 5,097,979.

[51] Int. Cl.[5] ..... B65D 90/04

[52] U.S. Cl. ..... 220/404; 220/470; 217/3 R

[58] Field of Search ..... 220/404, 470; 217/3 R

[56] References Cited

U.S. PATENT DOCUMENTS

| | | | |
|---|---|---|---|
| 1,465,367 | 8/1923 | Schwartz | 220/404 |
| 1,653,556 | 12/1927 | Faber | 220/404 X |
| 2,036,723 | 4/1936 | Kline . | |
| 2,573,770 | 11/1951 | Meadow . | |
| 2,610,757 | 9/1952 | Irvine | 383/76 X |
| 3,349,936 | 10/1967 | Morton et al. . | |
| 3,396,885 | 8/1968 | Giondi . | |
| 4,216,256 | 8/1980 | Lindner . | |
| 4,489,815 | 12/1984 | Martinez et al. . | |
| 4,993,551 | 2/1991 | Lindsay | 383/39 X |
| 5,084,321 | 1/1992 | Sui . | |
| 5,097,979 | 3/1992 | McDermott et al. | 220/404 |
| 5,181,627 | 1/1992 | McDermott et al. | 220/404 |

*Primary Examiner*—Allan N. Shoap
*Assistant Examiner*—Jes F. Pascua
*Attorney, Agent, or Firm*—Zarley, McKee, Thomte, Voorhees & Sease

[57] ABSTRACT

The basket liner of the present invention includes a sheet which is designed for a basket of the type have at least one handle having forward and rearward legs connected to and extending upwardly from front and rearward panels of the basket. The liner sheet includes front and rear edges, opposing first and second side edges, and upper and lower surfaces. The sheet is connected to the handle leg portions adjacent the forward and rearward edges of the sheet, to maintain the liner in position. One embodiment of the invention includes a ribbon attached to the lower surface of the sheet adjacent the front edge, with the ends of the ribbon tied around the handle front leg. A second ribbon attached to the lower surface adjacent the rearward edge of the sheet is tied around the rear leg of the handle, to secure the liner in position. In a second embodiment of the invention, the attachment of the ribbons to the sheet is through a pair of slots or buttonholes, thereby permitting removal of the ribbon.

5 Claims, 7 Drawing Sheets

BASKET LINER

CROSS-REFERENCE TO RELATED APPLICATION

This is a continuation-in-part application of Ser. No. 07/890,443 filed May 27, 1992 entitled "Basket Liner" which issued as U.S. Pat. No. 5,240,134 which is a divisional of Ser. No. 07/842,217 filed Feb. 26, 1992 entitled "Basket Liner", which issued as U.S. Pat. No. 5,181,627, which is a continuation-in-part of Ser. No. 07/690,109 filed Apr. 23, 1991 entitled "Basket Liner", which issued as U.S. Pat. No. 5,097,979.

BACKGROUND OF THE INVENTION

Baskets have been utilized for centuries for the transportation and display of various products. It is, therefore, desirable to provide lining for such baskets, so as to create decorative alternatives for the consumer. It is therefore a general object of the present invention to provide an improved basket liner.

Another object of the present invention is to provide a basket liner which may be anchored into position.

Yet another object of the present invention is to provide a basket liner with anchors which are decorative in nature.

Yet another object is to provide a basket liner which is simple and economical to manufacture.

Still another object of the present invention is to provide a basket liner which is quick and simple to utilize.

These and other objects will be apparent to those skilled in the art.

SUMMARY OF THE INVENTION

The basket liner of the present invention includes a sheet which is designed for a basket of the type have at least one handle having forward and rearward legs connected to and extending upwardly from front and rearward panels of the basket. The liner sheet includes front and rear edges, opposing first and second side edges, and upper and lower surfaces. The sheet is connected to the handle leg portions adjacent the forward and rearward edges of the sheet, to maintain the liner in position. One embodiment of the invention includes a ribbon attached to the lower surface of the sheet adjacent the front edge, with the ends of the ribbon tied around the handle front leg. A second ribbon attached to the lower surface adjacent the rearward edge of the sheet is tied around the rear leg of the handle, to secure the liner in position. In a second embodiment of the invention, the attachment of the ribbons to the sheet is through a pair of slots or buttonholes, thereby permitting removal of the ribbon.

DESCRIPTION OF THE PREFERRED EMBODIMENTS

Figure 1:
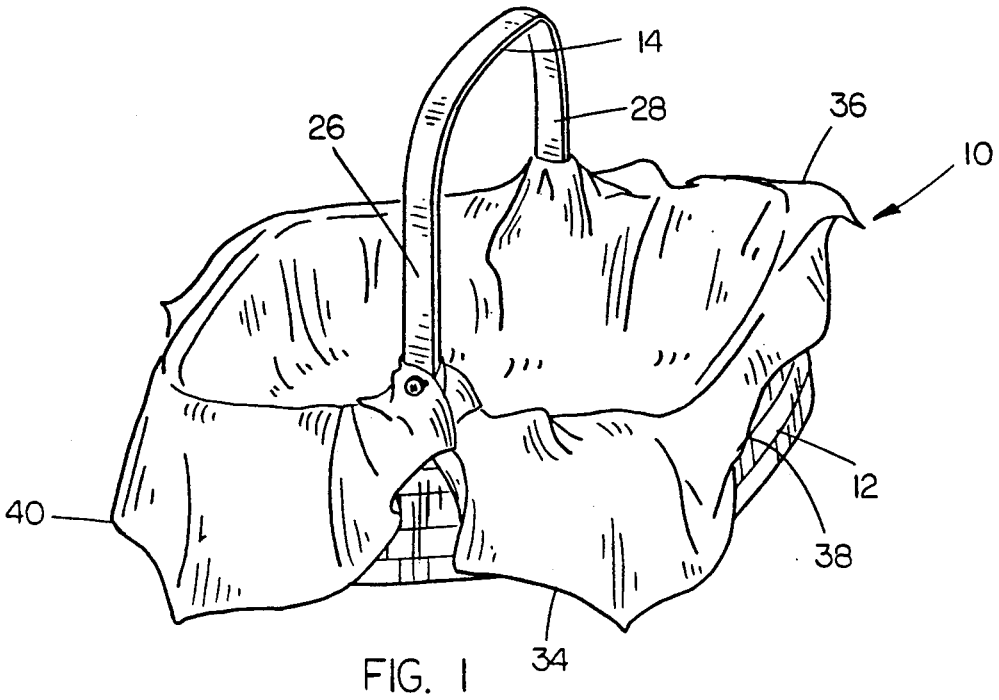
FIG. 1 is a perspective view of the basket liner of the present invention mounted on a basket.

Referring now to the drawings, in which similar or corresponding parts are identified with the same reference numeral, and more particularly to FIG. 1, the basket liner of the present invention is designated generally at 10 and is shown fastened to a basket 12 having an upstanding handle 14.

Figure 3:
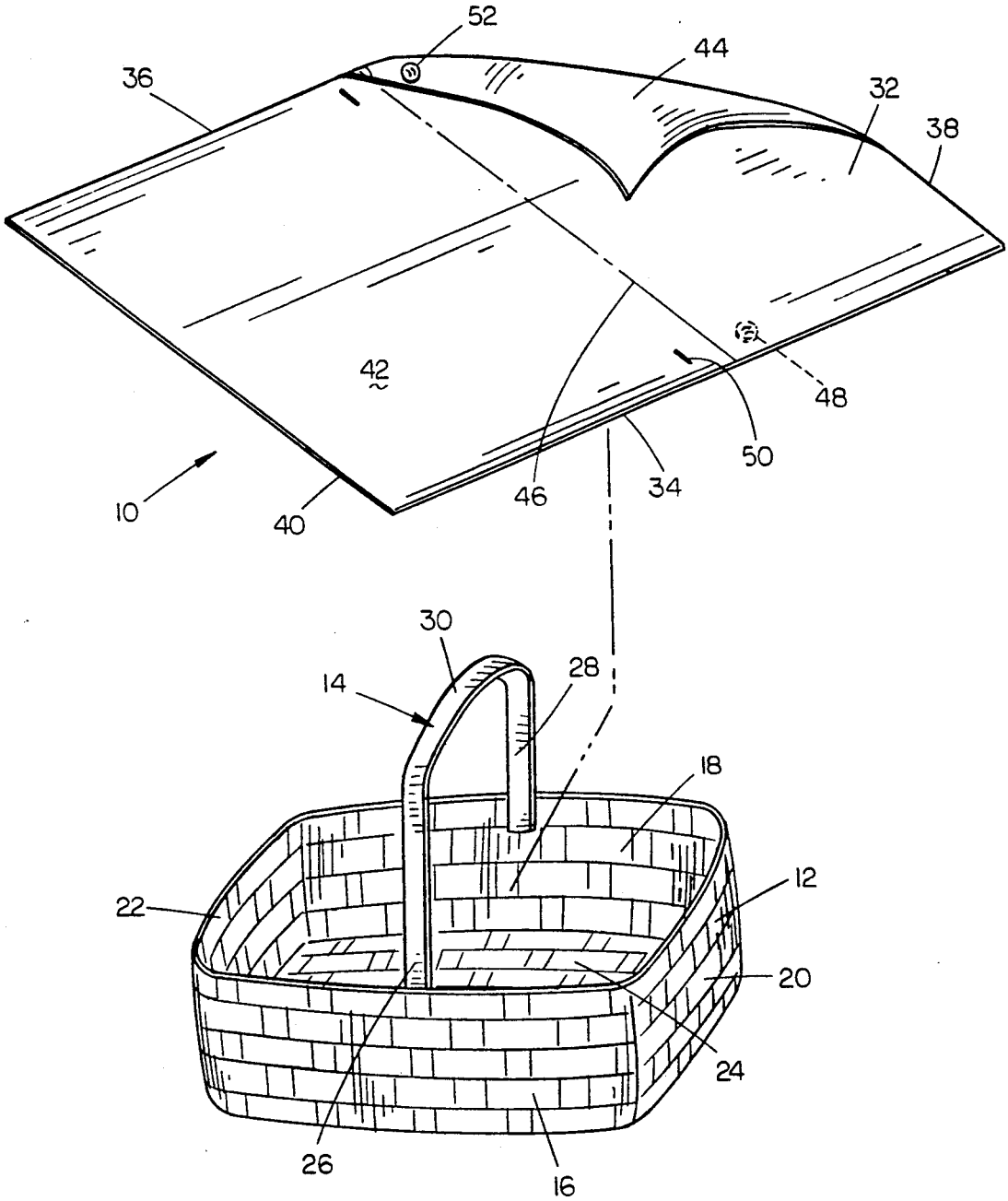
FIG. 3 is a perspective view of a basket with the basket liner of this invention removed therefrom.

Referring now to FIG. 3, basket 12 has forward and rearward upstanding panels 16 and 18 respectively, opposing upstanding side panels 20 and 22 and a bottom 24. Handle 14 includes a pair of legs 26 and 28 affixed to front and rear panels 16 and 18 respectively, and projecting upwardly therefrom. Legs 26 and 28 are connected by a cross-member 30 to form generally U-shaped handle 14.

Basket liner 10 is formed from a generally rectangular sheet of fabric 32 and includes a forward edge 34, rearward edge 36 opposing side edges 38 and 40 an upper surface 42 and lower surface 44. A center line 46 is indicated on fabric sheet 32 and is located midway between side edges 38 and 40.

Preferably, fabric sheet 32 has a width, as measured along side edges 38 and 40, approximately equal to the height of front and rear panels 16 and 18 and the width of bottom 24 (as measured between front and rear panels 16 and 18) of basket 12. Similarly, it is preferred that the length of fabric sheet 32 is equal to the length of basket bottom 24 added to the height of side panels 20 and 22. In this way, when basket liner 10 is installed in basket 12, the respective edges 34, 36, 38 and 40 will drape over the sides of the basket, as shown in FIG. 1.

A button 48 is sewn to the lower surface 44 of fabric sheet 32 adjacent to and spaced slightly from forward edge 34 and adjacent but spaced slightly from center line 46, as shown in FIG. 3. A buttonhole 50 is formed in fabric sheet 32 and spaced the same distance from center line 46 but on the opposite side thereof, to receive button 48 when fabric sheet 32 is fastened to basket 12. A second button 52 is affixed to the lower surface 44 of sheet 32 directly opposite button 48, adjacent rear edge 36. A second buttonhole 54 is formed in sheet 32 adjacent rear edge 36 directly opposite buttonhole 50, to receive button 52 when sheet 32 is affixed to basket 12.

Figure 2:
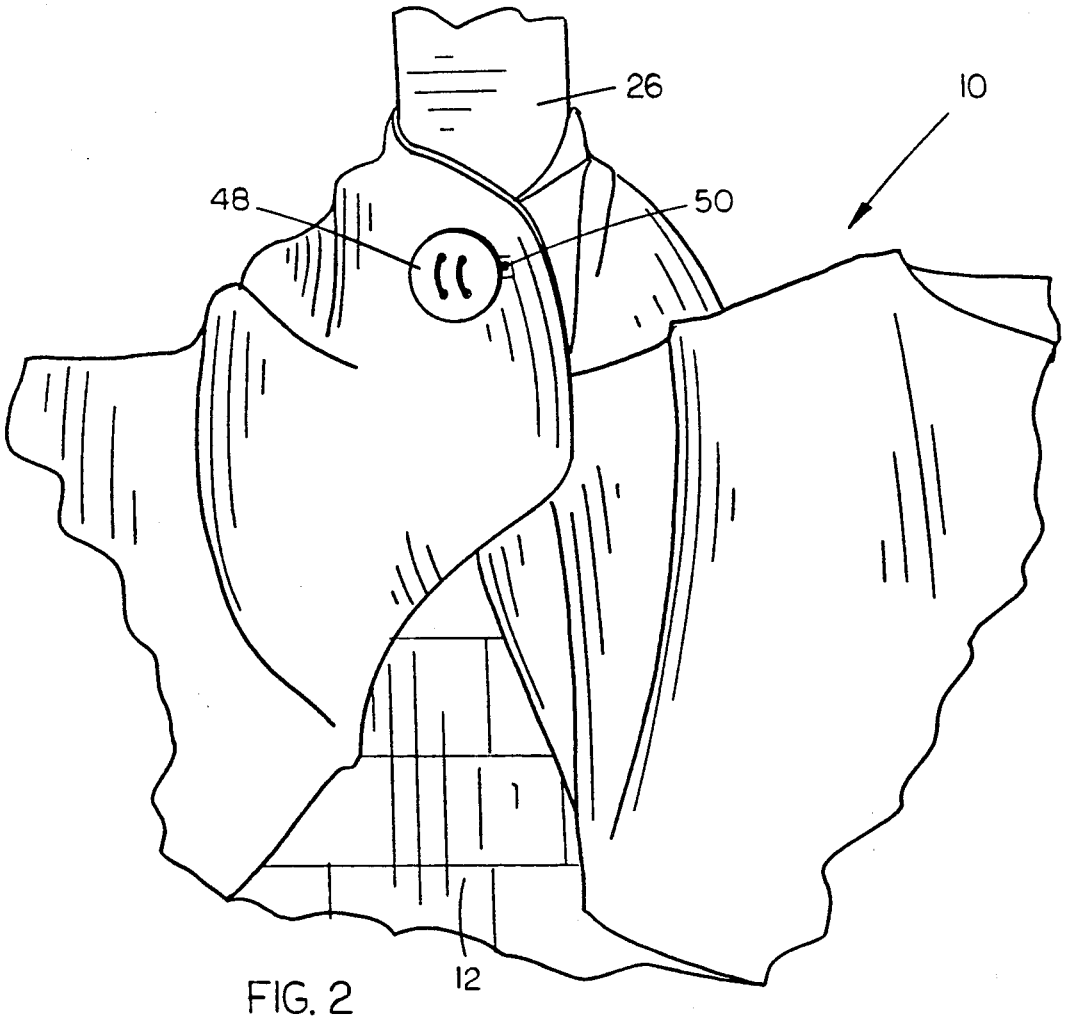
FIG. 2 is an enlarged perspective view of one anchor point of the liner to the basket of FIG. 1.

As shown in FIGS. 1 and 2, basket liner 10 is anchored to basket 12 by laying sheet 32 into basket 12 with the lower surface 44 contacting the bottom 24 of the basket. Button 48 will be facing forward panel 16, and a portion of forward edge 34 is wrapped around leg 26 of handle 14 so as to fasten button 48 through buttonhole 50 to anchor basket liner 10 to leg 26. A similar process is utilized with leg 28 of handle 14 to fasten basket liner 10 thereto.

Figure 4:
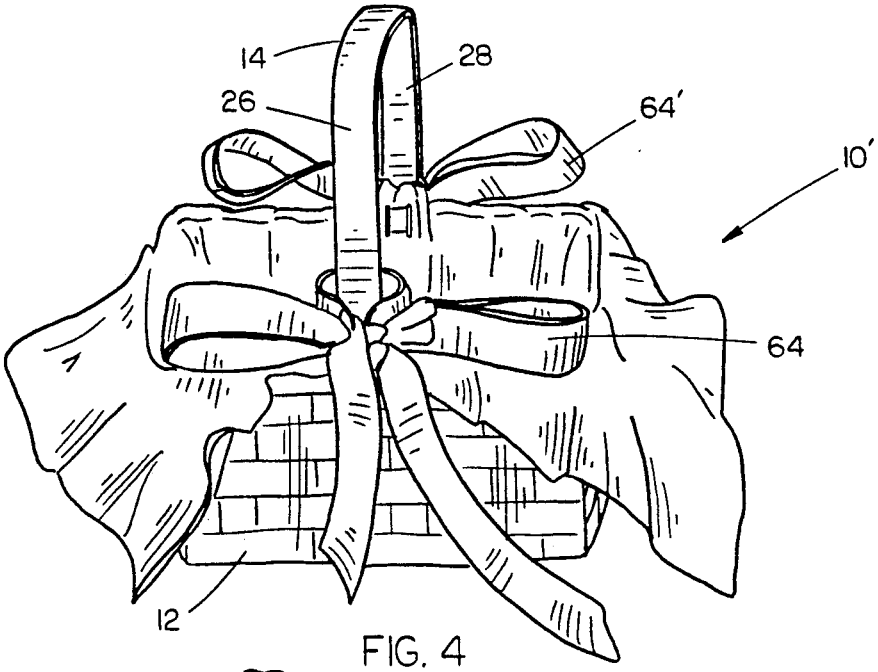
FIG. 4 is a perspective view of a second embodiment of the basket liner of the invention.
Figure 5:
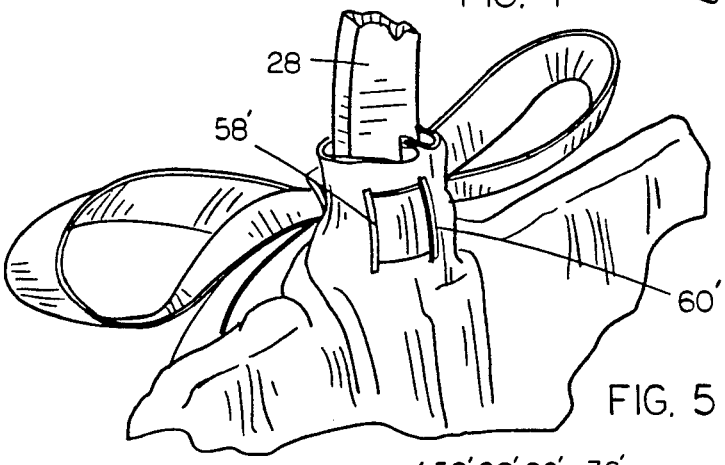
FIG. 5 is a enlarged perspective view of one anchor of the second embodiment of the invention.
Figure 6:
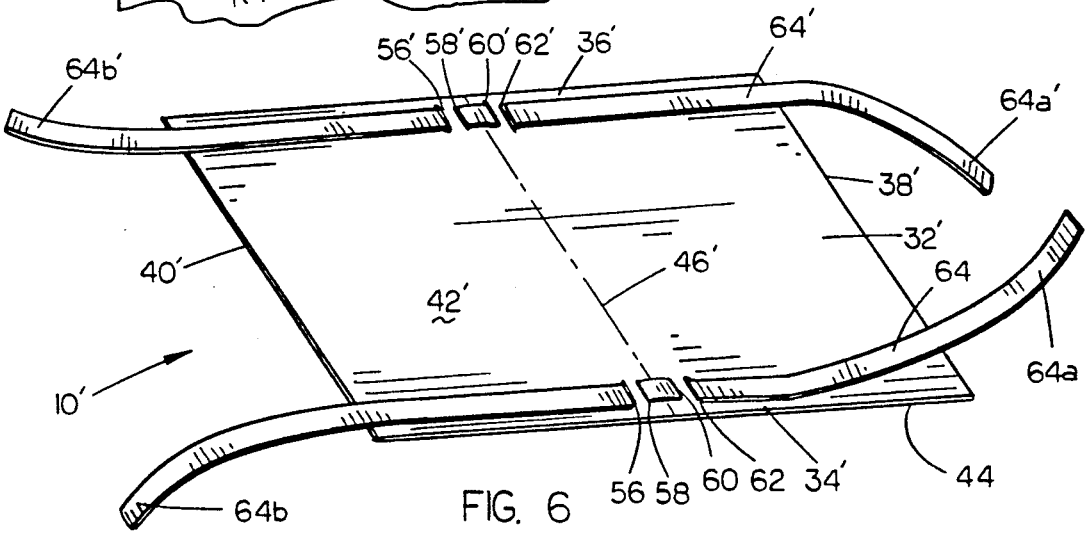
FIG. 6 is a perspective view of the second embodiment of the basket liner removed from the basket.

Referring now to FIGS. 4, 5 and 6, a second embodiment of the basket liner is designated generally at 10' which is designed for anchoring to basket 12. As shown in FIG. 6, basket liner 10' begins with a sheet 32' having the same dimensions as the sheet 32 of the first embodiment, and including forward and rearward edges 34' and 36', side edges 38' and 40' and upper and lower surfaces 42' and 44' respectively. A center line 46' is drawn on sheet 32' midway between side edges 38' and 40', merely for reference purposes.

Four buttonholes 56, 58, 60 and 62 are formed parallel to one another and spaced apart adjacent forward edge 34', with buttonholes 56 and 58 spaced equidistant away from center line 46' and opposite to buttonholes 60 and 62. A similar arrangement of buttonholes 56', 58', 60' and 62' are formed adjacent rear edge 36', as shown in FIG. 6.

An elongated strip of ribbon 64 is woven through buttonholes 56–62, downward through buttonhole 62 upward through buttonhole 60 downward through buttonhole 58 and thence upward through buttonhole 56 such that the ends 64*a* and 64*b* of the ribbon 64 extend along the upper surface 42' of sheet 32'. A second ribbon 64' is woven through buttonholes 56'–62' in the same fashion so as to be oriented parallel to ribbon 64.

Basket liner 10' is anchored to basket 12 by laying the liner in the basket with the lower surface 44' thereof in contact with the bottom of the basket. The portion of sheet 32' adjacent each leg 26 and 28 of handle 14 is wrapped around the respective handle leg 26 and 28 and ribbons 64 and 64' are tied together so as to anchor sheet 32' in position, as shown in FIG. 4. FIG. 5 shows the interior face of leg 28 and shows that buttonholes 58' and 60' are located interiorly of leg 28 with the remaining buttonholes 56' and 62' (not seen in FIG. 5) located towards the outside of leg 28. Preferably, ribbons 64 and 64' are tied in bows or some other decorative fashion.

Figure 7:
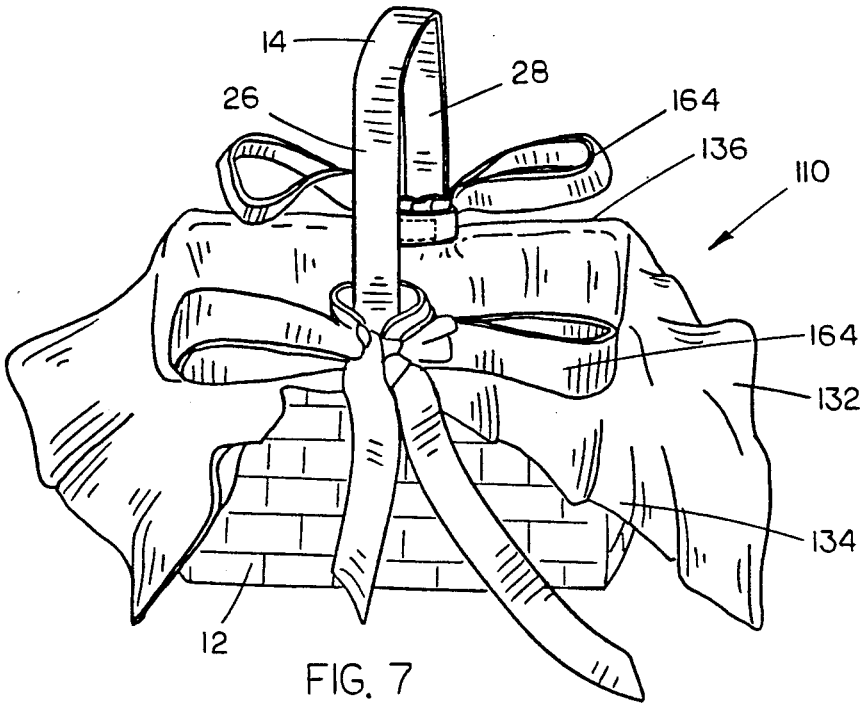
FIG. 7 is a perspective view of a third embodiment of the basket liner of the invention.
Figure 8:
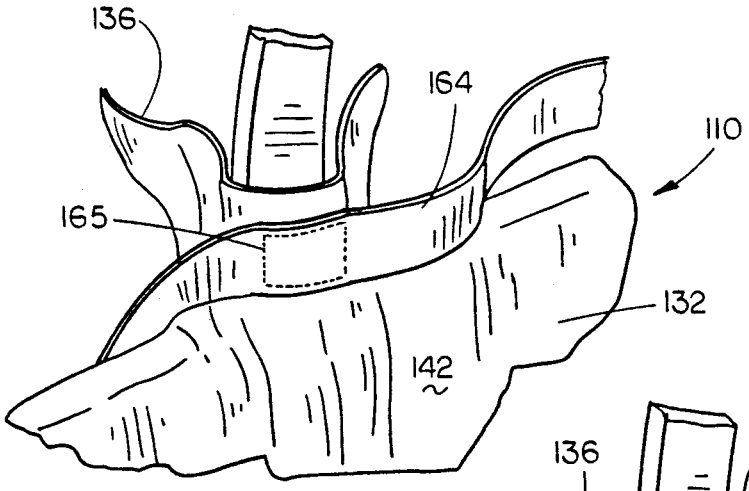
FIG. 8 is an enlarged perspective view of one anchor of the third embodiment of the invention.

Referring now to FIGS. 7 and 8, a third embodiment of the basket liner is designated generally at 110, and includes the same generally rectangular sheet 132 having the same dimensions as sheet 32 of the first embodiment. Sheet 132 has forward and rearward edges 134 and 136 which are anchored to upstanding legs 26 and 28 of basket handle 14, respectively.

An elongated strip of ribbon 164 is utilized to anchor sheet 132 to basket 12, in a fashion similar to that of the second embodiment shown in FIG. 4. However, rather than weaving the ribbon through slots, ribbon 164 is attached directly to the upper surface 142 adjacent forward and rearward edges 134 and 136. As shown in FIG. 8, ribbon 164 may be attached by stitching 165, or other equivalent method. Sheet 132 is then anchored to legs 26 and 28 by wrapping the associated edge 134 and 136 about the handle legs and tieing a bow with each ribbon 164, as shown in FIG. 7.

Figure 9:
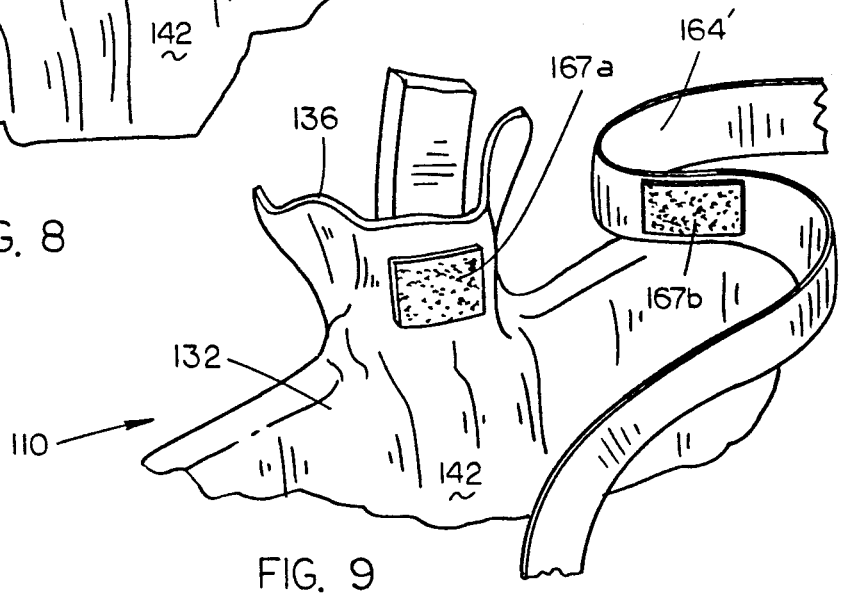
FIG. 9 is an enlarged perspective view similar to FIG. 8 showing a different anchor for the third embodiment of the invention.

FIG. 9 shows ribbon 164' removably attached to sheet 132 utilizing a first half 167*a* of a hook and loop fastener mounted to adjacent edge 136 on the upper surface 142 of sheet 132. The second half 167*b* of the hook and loop fastener is mounted on ribbon 164'. In this way, ribbon 164' may be selectively removed from the sheet 132, to permit laundering of sheet 132, or the like. Selectively detachable ribbon 1641 may also be exchanged for different colors or styles on a particular basket liner 110, thereby providing greater variety.

Figure 10:
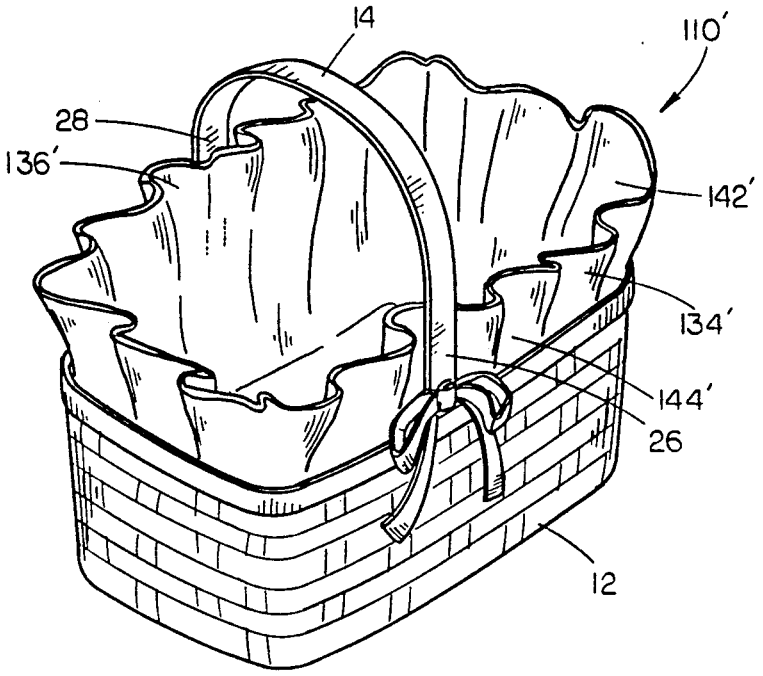
FIG. 10 is a perspective view of a fourth embodiment of the invention.

Referring now to FIGS. 10–15, a fourth embodiment of the basket liner is designated generally at 110', and is essentially the same as third embodiment 110, except that liner 110' has been inverted so that ribbon 164' is fastened to the lower surface 144' rather than the upper surface 142' of the sheet. As shown in FIG. 10, this orientation of basket liner 110' produces a different looking product, while retaining the function of fastening the liner to basket handle 14.

Liner 110' includes the same generally rectangular sheet 132' having the same dimensions as sheet 132 of the third embodiment. Sheet 132' has forward and rearward edges 134' and 136', which are anchored to upstanding legs 26 and 28 of handle 14, respectively.

Figure 11:
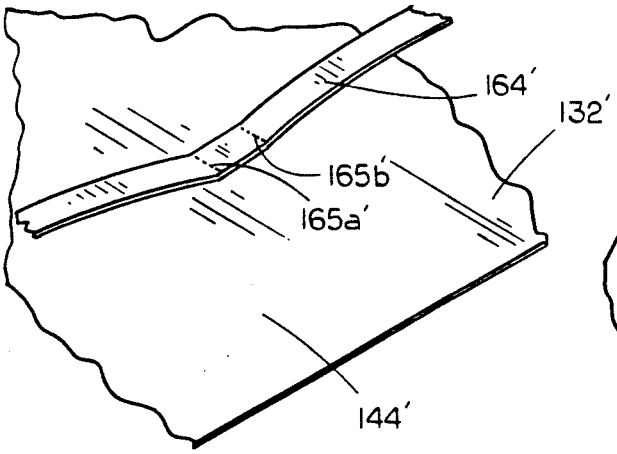
FIG. 11 is an enlarged perspective view of one anchor of the fourth embodiment of the invention.
Figure 15:
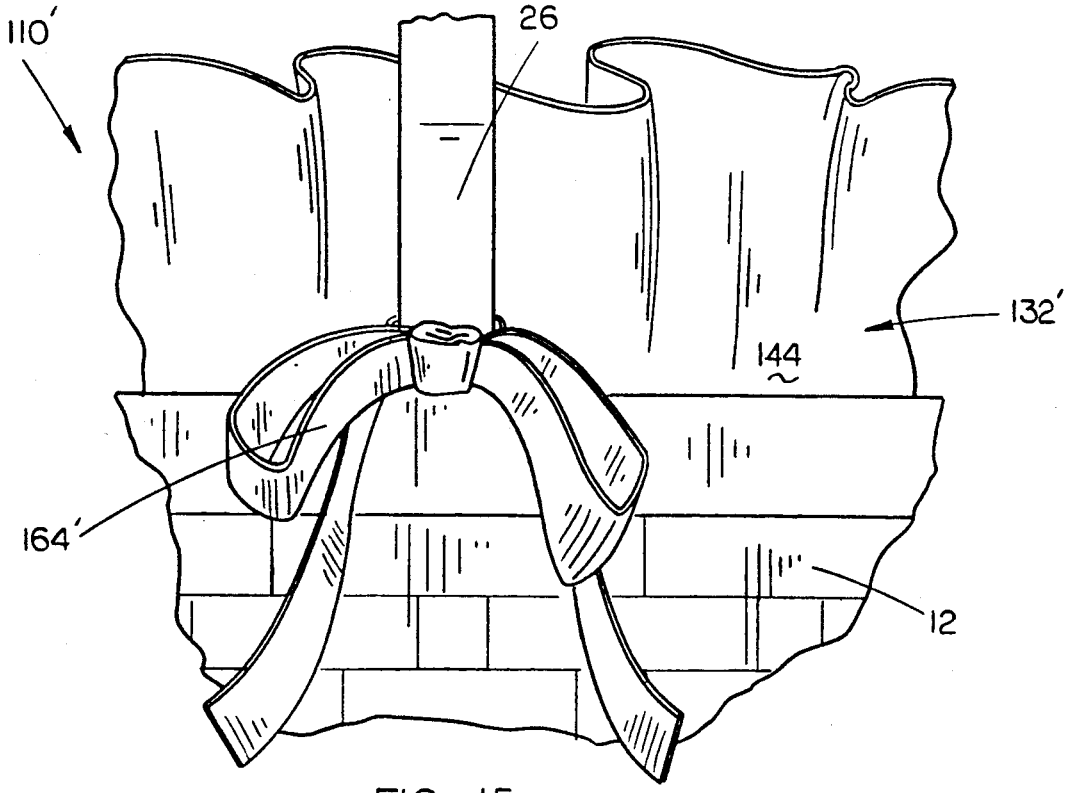
FIG. 15 is an enlarged perspective view similar to FIG. 14, showing the anchor of FIG. 11 in the fastened position.

An elongated strip of ribbon 164' is utilized to anchor sheet 132' to basket 12, as shown in FIGS. 10 and 15. However, since ribbon 164' is attached to the lower surface 1441 of sheet 1321', ribbon 164' will wrap around the legs of handle 14 without a portion of sheet 132' between the ribbon and handle, as required in the embodiment of FIGS. 7–9. As shown in FIG. 11, ribbon 164' may be attached by two vertical spaced apart lines of stitching 165'*a* and 165'*b*.

Figure 12:
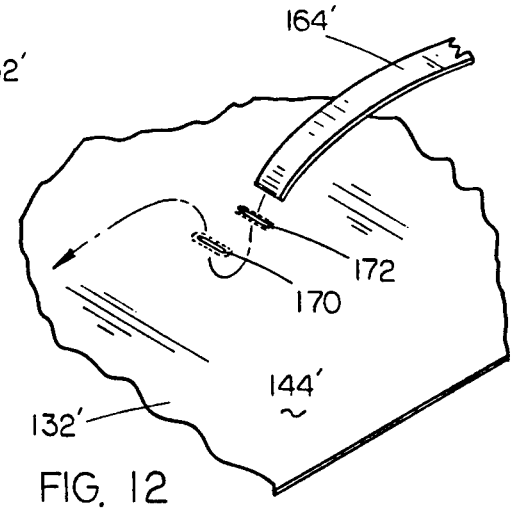
FIG. 12 is an enlarged perspective view of a different anchor of the fourth embodiment of the invention.
Figure 14:
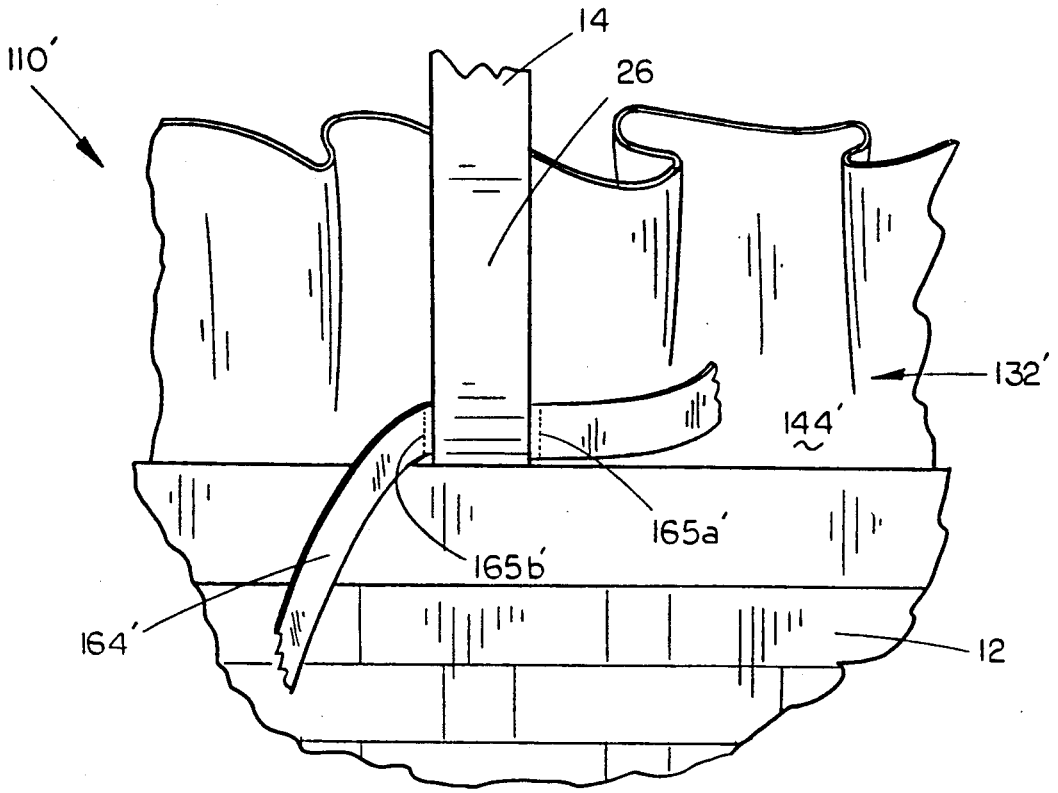
FIG. 14 is an enlarged perspective view of the anchor of FIG. 11 prior to fastening on the basket handle.

FIG. 12 shows an alternative method of connecting ribbon 164' to sheet 132', by threading the ribbon through a pair of slots or buttonholes 170 and 172. It should be noted that if the distance between buttonholes 170 and 172 (or between stitches 165'*a* and 165'*b*) is greater than the width of the basket handle leg, a portion of sheet 132' will wrap around the basket leg as the ribbon 164' is tied in position, in a fashion similar to that of the third embodiment. However, it is preferred that the distance between the buttonholes 170 and 172 (or between the stitches 165'*a* and 165'*b*) is less than the width of the associated handle leg 26 or 28, such that sheet 132' will not partially wrap around the handle leg upon fastening of the ribbon, as shown in FIGS. 14 and 15. As with the previous embodiments, sheet 132' is anchored to legs 26 and 28 by wrapping the free ends of ribbon 164' about the handle legs and tying a bow with each ribbon.

Figure 13:
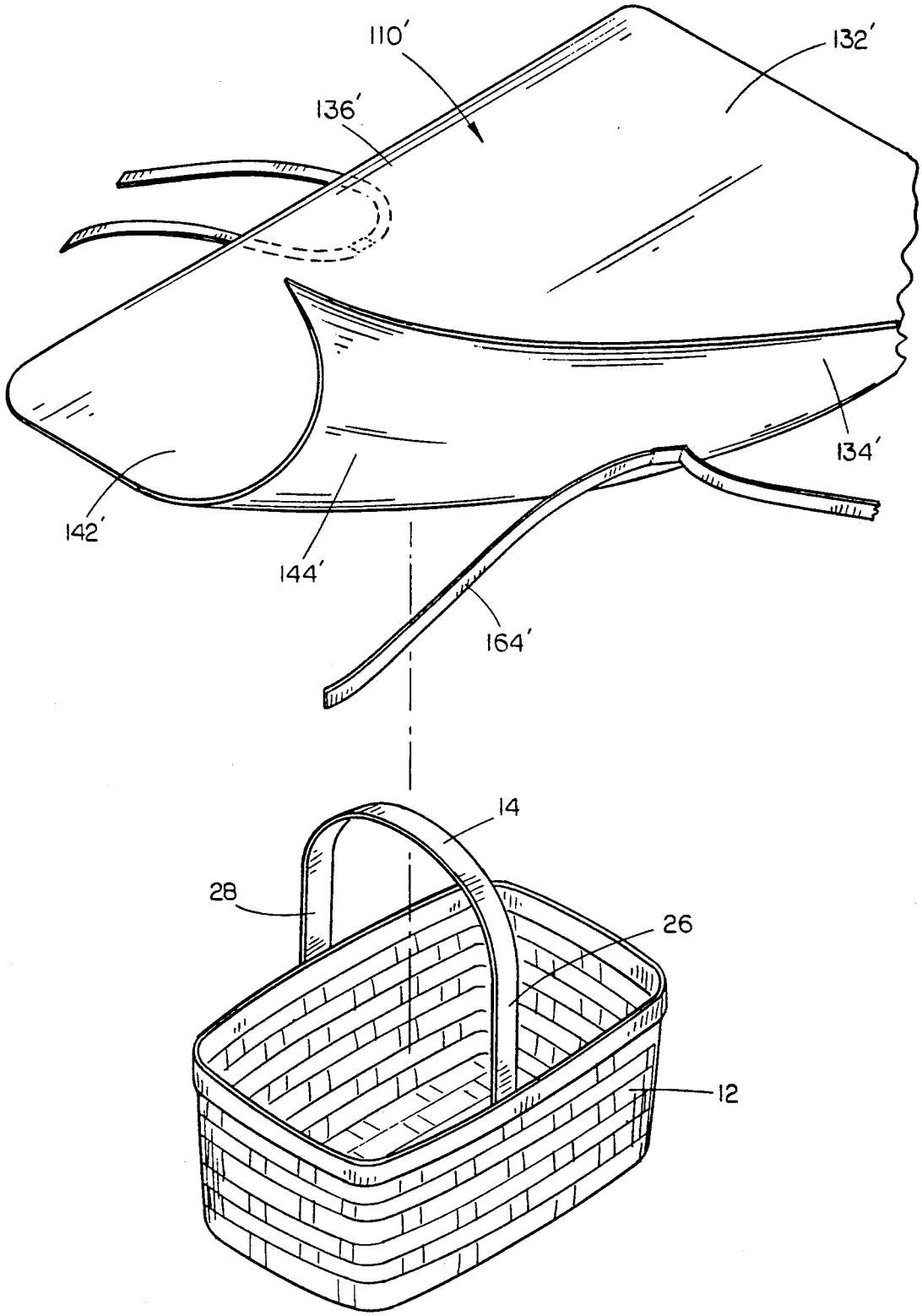
FIG. 13 is a perspective view of the basket liner of the fourth embodiment removed from the basket.

While FIGS. 11 and 12 show two methods of attaching a ribbon to sheet 130', various other methods of attachment, detachable or otherwise, are foreseen. Similarly, it is intended that the method of fastening sheet 132' to handle legs 26 and 28 may be utilized on either the upper or lower surface of the sheet, thereby permitting the liner to be inverted yet still fastened in position. Similarly, while FIGS. 11, 13 and 14 show a single ribbon 164' attached to sheet 132' intermediate its free ends, it is foreseen that two separate ribbon portions could be utilized with one end connected to the sheet and the free ends tied together around the handle to provide a similarly fastened liner.

Whereas the invention has been shown and described in connection with the preferred embodiments thereof, it will be understood that many modifications, substitutions and additions may be made which are within the intended broad scope of the appended claims. For example, the dimensions of the basket liner may be greater than the inner dimensions of the basket, to create additional overlapping edges.

There has therefore been shown and described an improved basket liner which accomplishes at least all of the above stated objects.

We claim:

1. In combination:

a basket having front and rear upstanding panels each having an upper edge, opposing upstanding first and second side panels, a bottom, and a handle having a front leg projecting upwardly from the front panel and a rear leg projecting upwardly from the rear panel; and a basket liner connected to said basket handle, comprising: a sheet having front and rear edges, opposing first and second side edges, an upper surface and a lower surface;

first means adjacent the front edge of said sheet and extending outwardly from the lower surface thereof, for connecting said sheet to said first leg of said handle at a location such that the front edge is positioned above said front panel upper edge; and second means adjacent the rear edge of said sheet and extending outwardly from the lower surface thereof, for connecting said sheet to said rear leg at a location such that the rear edge is positioned above said rear panel upper edge.

2. The combination of claim 1, wherein:

said first connecting means includes a first ribbon having first and second ends, connected intermediate its ends to said sheet.

the ends of said first ribbon wrapped around said front leg and connected together;

said second connecting means includes a second ribbon having first and second ends, connected intermediate its ends to said sheet;

the ends of said second ribbon wrapped around said rear leg and connected together.

3. The combination of claim 2, further comprising means for removably connecting said ribbons to said sheet.

4. The combination of claim 1, wherein:

said first connecting means includes:

a first ribbon portion having first and second ends, the first end connected to said sheet and the second end extending outwardly from the lower surface thereof; and a second ribbon portion having first and second ends, the first end connected to said sheet and the second end extending outwardly from the lower surface thereof;

the second ends of said first and second ribbon portions wrapped around said front leg and connected together; and said second connection means includes:

a third ribbon portion having first and second ends, the first end connected to said sheet and the second end extending outwardly from the lower surface thereof; and a fourth ribbon portion having first and second ends, the first end connected to said sheet and the second end extending outwardly from the lower surface thereof;

the second ends of said third and fourth ribbon portions wrapped around said rear leg and connected together.

5. The combination of claim 1, wherein said panels and bottom have a first surface defining the sides and bottom of an interior of the basket, and wherein said first and second connecting means are located such that the portion of said sheet which extends between the first and second connecting means is located entirely within the interior of said basket.

* * * * *